US010519739B2

(12) United States Patent
Haverstad et al.

(10) Patent No.: US 10,519,739 B2
(45) Date of Patent: Dec. 31, 2019

(54) RAM FOR A BLOWOUT PREVENTER AND A BLOWOUT PREVENTER PROVIDED WITH RAMS

(71) Applicant: ELECTRICAL SUBSEA & DRILLING AS, Straume (NO)

(72) Inventors: Thor Arne Haverstad, Vennesla (NO); Erik Norbom, Hoevik (NO); J. Gilbert Nance, Katy, TX (US); John L. Alsup, Houston, TX (US); Bolie C. Williams, Houston, TX (US)

(73) Assignee: ELECTRICAL SUBSEA & DRILLING AS, Straume (NO)

( * ) Notice: Subject to any disclaimer, the term of this patent is extended or adjusted under 35 U.S.C. 154(b) by 0 days.

(21) Appl. No.: 15/768,836

(22) PCT Filed: Oct. 18, 2016

(86) PCT No.: PCT/NO2016/050207
§ 371 (c)(1),
(2) Date: Apr. 17, 2018

(87) PCT Pub. No.: WO2017/069635
PCT Pub. Date: Apr. 27, 2017

(65) Prior Publication Data

US 2018/0283126 A1 Oct. 4, 2018

(30) Foreign Application Priority Data

Oct. 19, 2015 (NO) ..... 20151422

(51) Int. Cl.
*E21B 33/06* (2006.01)

(52) U.S. Cl.
CPC ..... *E21B 33/062* (2013.01); *E21B 33/061* (2013.01); *E21B 33/063* (2013.01)

(58) Field of Classification Search
CPC ..... E21B 33/062; E21B 33/061; E21B 33/063
USPC ..... 251/1.2, 1.3; 166/361, 363
See application file for complete search history.

(56) References Cited

U.S. PATENT DOCUMENTS

| | | | | |
|---|---|---|---|---|
| 2,331,557 A | | 10/1943 | Lorehn et al. | |
| 3,102,709 A | * | 9/1963 | Allen | E21B 33/062 137/614.11 |
| 3,554,480 A | | 1/1971 | Rowe | |
| 3,946,806 A | * | 3/1976 | Meynier, III | E21B 29/08 166/55 |
| 4,089,532 A | * | 5/1978 | Kamyshnikov | E21B 33/062 251/1.3 |
| 4,323,256 A | | 4/1982 | Miyagishima et al. | |
| 4,655,431 A | * | 4/1987 | Helfer | E21B 33/062 251/1.3 |

(Continued)

OTHER PUBLICATIONS

B. Judge et al.: "Subsea Test valve in modified BOP cavity may help to minimize cost of required BOP testing", Drilling Contractor , pp. 56-58 (2006).

*Primary Examiner* — Umashankar Venkatesan
(74) *Attorney, Agent, or Firm* — Norman B. Thot

(57) ABSTRACT

A ram for a blowout preventer, the ram having a top side and a bottom side, a front and a back; a first front seal face and a second front seal face provided on the front of the ram; a fluid communication channel extending through the ram from the front to the back thereof, the first front seal face being provided above and the second seal face below the fluid communication channel.

19 Claims, 3 Drawing Sheets

(56) References Cited

U.S. PATENT DOCUMENTS

| | | | | |
|---|---|---|---|---|
| 5,009,289 | A * | 4/1991 | Nance | E21B 19/10 188/67 |
| 5,287,879 | A * | 2/1994 | Leggett | E21B 33/062 137/246.22 |
| 6,164,619 | A | 12/2000 | Van Winkle et al. | |
| 6,367,804 | B1 * | 4/2002 | Watts | E21B 33/062 251/1.2 |
| 6,719,262 | B2 | 4/2004 | Whitby et al. | |
| 7,255,329 | B1 * | 8/2007 | Sedens | F16K 3/314 251/327 |
| 8,573,557 | B2 | 11/2013 | Carbaugh et al. | |
| 2003/0024705 | A1 * | 2/2003 | Whitby | E21B 33/064 166/363 |
| 2017/0159391 | A1 * | 6/2017 | Dev | B29C 45/1676 |

* cited by examiner

RAM FOR A BLOWOUT PREVENTER AND A BLOWOUT PREVENTER PROVIDED WITH RAMS

CROSS REFERENCE TO PRIOR APPLICATIONS

This application is a U.S. National Phase application under 35 U.S.C. § 371 of International Application No. PCT/NO2016/050207, filed on Oct. 18, 2016 and which claims benefit to Norwegian Patent Application No. 20151422, filed on Oct. 19, 2015. The International Application was published in English on Apr. 27, 2017 as WO 2017/069635 A1 under PCT Article 21(2).

FIELD

The present invention relates to a ram assembly with a bi-directional sealing capability, and in particular to a bi-directional sealing ram assembly for blow out preventer systems used in petroleum exploration and exploitation. In a further aspect, the present invention relates to a blowout preventer having bi-directional seal rams.

BACKGROUND

Blowout preventers (BOPs) are used in various petroleum operations, such as drilling or well intervention, to seal off the well during normal operations or in case of an emergency. BOPs are usually arranged in a stack of ram-type and annular preventers arranged at the wellhead, the design and operation of which is well-known to persons skilled in the art and is therefore not repeated herein.

Drilling operators are required to regularly test the BOPs in operation. This conventionally requires pulling the drill string in order to carry out the test, which is a time-consuming and thus expensive operation. Significant cost savings can be achieved by using a test valve or another ram-type BOP at the lower end of the BOP stack to seal off the wellbore around the drill string and to perform pressure tests on the BOPs higher up in the stack. This is described in Bob Judge and Gary Leach, "Subsea test valve in modified BOP cavity may help to minimize cost of required BOP testing", Drilling Contractor magazine, November/December 2006, pp. 56-58. Additional background information is described in U.S. Pat. Nos. 6,164,619, 6,719,262 and 8,573,557.

U.S. Pat. No. 6,719,262 describes a bi-directional sealing blow out preventer. The unit described in U.S. Pat. No. 6,719,262 is capable of sealing around a drill string against fluid from below for well control as well as sealing around a drill string against fluid pressure from above for testing or pressure-activating other apparatus. The rams thereby seal against the guideway surface all around the ram bodies. No pressure equalization groove can thus exist between the front of the ram and the back as is common in conventional BOP rams. For this purpose, U.S. Pat. No. 6,719,262 describes a fluid communication system to equalize the fluid pressure between the back and the front of the ram. This is necessary in order to avoid a significant pressure differential across the ram, and thus allow the actuators to move the rams effectively.

SUMMARY

An aspect of the present invention is to provide a system with low complexity and with a reduced number of components that are prone to malfunction or which require maintenance or replacement in a safety-critical system such as a BOP in view of the fact that such systems are often used in remote locations (e.g., subsea). Another aspect of the present invention is to provide an improved bi-directional sealing ram assembly capable of sealing around a drill string against fluid from below for well control as well as sealing around a drill string against fluid pressure from above.

In an embodiment, the present invention provides a ram for a blowout preventer which includes a top side, a bottom side, a front, a back, a fluid communication channel arranged to extend through the ram from the front to the back, a first front seal face arranged on the front of the ram above the fluid communication channel, and a second front seal face arranged on the front of the ram below the fluid communication channel.

BRIEF DESCRIPTION OF THE DRAWINGS

The present invention is described in greater detail below on the basis of embodiments and of the drawings in which.

DETAILED DESCRIPTION

Figure 1:
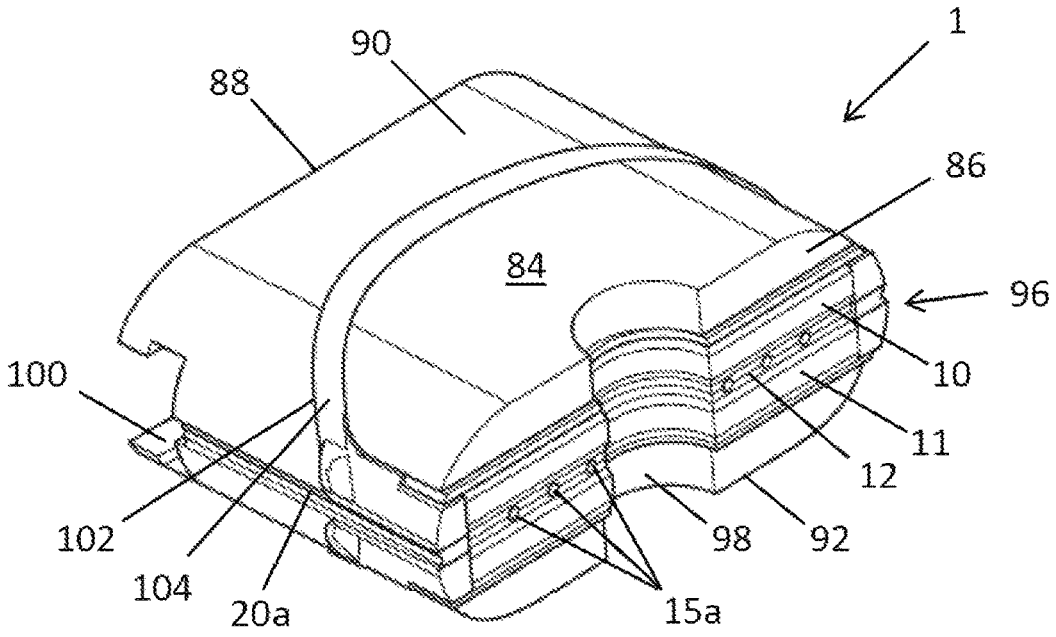
FIG. 1 shows a perspective illustration of a ram for a blowout preventer according to the first aspect of the present invention.
Figure 2:
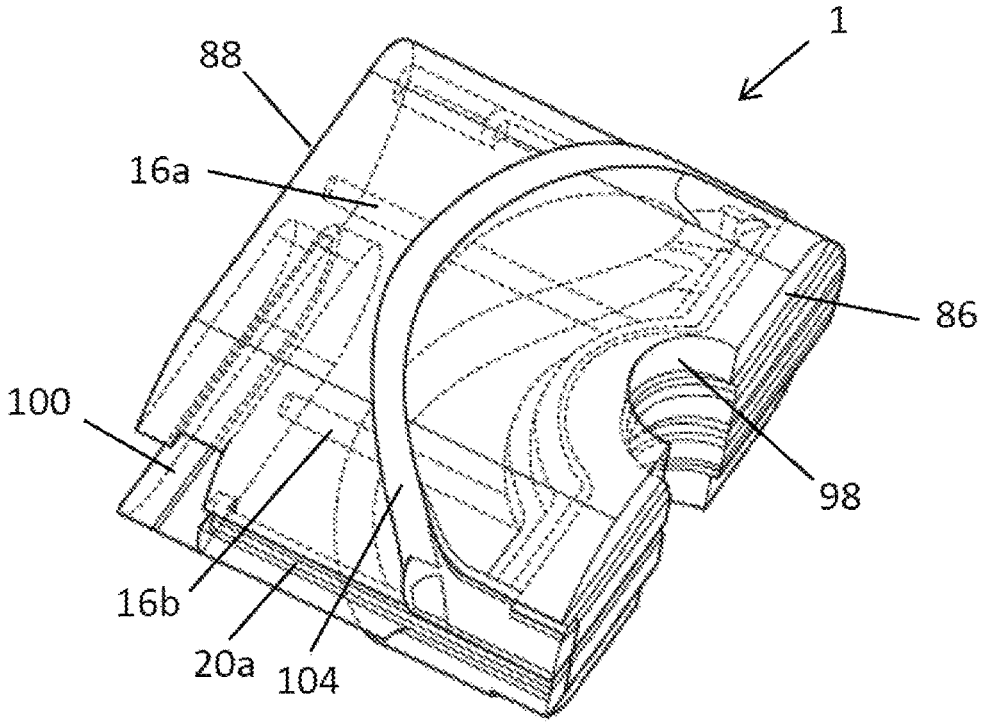
FIG. 2 shows a perspective illustration of the ram illustrated in FIG. 1 with the internal features illustrated in broken lines.

In an embodiment, the present invention provides a ram for a blowout preventer, the ram having a top side and a bottom side, a front and a back, a first front seal face and a second front seal face provided on the front of the ram, a fluid communication channel extending through the ram from the front to the back thereof, the first front seal face being provided above and the second seal face below the fluid communication channel.

The fluid communication channel can, for example, allow a fluid communication between the volume in front of and the volume behind the ram, thus providing that the ram can be effectively moved in its guideway in a blowout preventer, while obviating the need for the complex fluid communication system described in U.S. Pat. No. 6,719,262.

In an embodiment of the present invention, the ram can, for example, have a ram body with a front end and a back end, and a front groove which extends across the front end, the first seal face and second seal face being provided on a packer element mounted in the front groove.

In this embodiment, the fluid communication channel can, for example, comprise a packer passage which extends through the packer from a port located between the first seal face and the second seal face to the ram body, and a ram body passage which extends through the ram body from the groove to the back end of the ram body.

The packer element can, for example, be provided with a plurality of ports located between the first seal face and the second seal face, and the fluid communication channel may comprise a plurality of packer passages each of which extends through the packer from one of the ports to the ram body.

The fluid communication channel can, for example, comprise a plurality of ram body passages, each of which extends from the groove to the back end of the ram body.

Where the fluid communication channel comprises a plurality of packer passages and a plurality of ram body passages, there can, for example, be more packer passages than ram body passages.

The ram can, for example, be provided with a packer retaining pin which extends from the front of the ram to the back, and which engages with the packer element and the ram body to assist in retaining the packer element in the groove. The fluid communication channel can in this case include a passage which extends along the packer retaining pin from the front to the back of the ram.

In an embodiment, the ram can, for example, include a top seal face provided on the top side of the ram and a bottom seal face provided on the bottom side of the ram.

Where the ram is provided with a packer element, the top seal face and bottom seal face can, for example, cooperate with the packer element to provide a top seal loop and a bottom seal loop.

In an embodiment, the top seal face can, for example, cooperate with the first front seal face to provide a top seal loop, while the bottom seal face can, for example, cooperate with the second front seal face to provide a bottom seal loop.

The front of the ram can, for example, be provided with a semi-cylindrical groove which extends from the top side to the bottom side of the ram.

In an embodiment, the present invention provides a blowout preventer (BOP) having a first ram and second ram both according to the first aspect of the present invention.

The blowout prevent can, for example, include a housing having a main passage, the rams being arranged in the housing so that the rams are opposite to one another with the front of each ram facing into the main passage, the rams being movable between a closed position in which the first front seal face of the first ram engages with the first front seal face of the second ram and the second front seal face of the first ram engages with the second front seal face of the second ram, and an open position in which the front of the first ram is spaced from the front of the second ram.

Where the front of each ram is provided with a semi-cylindrical groove which extends from the top side to the bottom side of the ram, the rams can, for example, be arranged in the housing so that, when they are in the closed position, the semi-cylindrical grooves come together to form a cylindrical passage which extends generally parallel to a longitudinal axis of the main passage in the housing. By virtue of this arrangement, the rams may seal around a drill string extending through the blowout preventer to close the main passage of the housing when the drill string is present.

Where each ram includes a top seal face provided on the top side of the ram and a bottom seal face provided on the bottom side of the ram, the housing may be provided with a corresponding seal surfaces which, when the rams are in the closed position, engage with the top seal face and bottom seal face to substantially prevent leakage of fluid between the rams and the housing from the main passage of the housing below the rams to the main passage of the housing above the rams and vice versa.

FIGS. 1 to 4 show a ram 1 for a blowout preventer (BOP) according to the first aspect of the present invention. The ram 1 has a ram body 84 with a front end 86, a back end 88, a top 90 and a bottom 92. In the front end 86, there is provided a receptacle or groove 94 (best illustrated in FIG. 3) in which there is mounted a packer element 96. The front end 86 and the packer element 96 is broken by a vertical semi-cylindrical groove 98, allowing the packer element 96 to seal around a drill pipe received in the vertical semi-cylindrical groove 98.

The back end 88 of the ram body 84 has a T-slot 100 to receive a button on the end of a piston or the like (not shown in the drawings) whereby the ram 1 is driven forward or retracted by an actuator (not shown in the drawings) in the blow out preventer.

Each top 90 of the ram body 84 is broken by a groove 102 that extends across the top 90 and connects to the groove 94 of the packer element 96. A top seal 104 is mounted in the top groove 102 to provide a sliding seal with the surface of the guideway (not shown in the drawings) in which the ram 1 resides during normal use.

Figure 3:
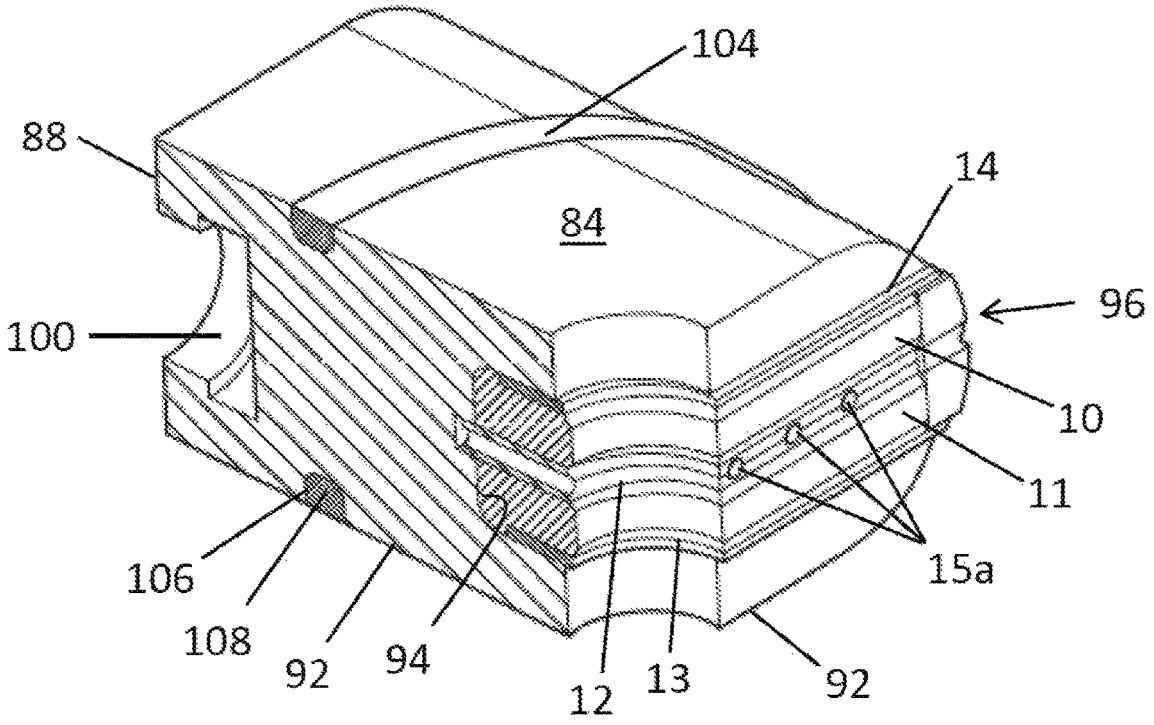
FIG. 3 shows a perspective illustration of a longitudinal vertical cross-section through the ram illustrated in FIGS. 1 and 2.

Equivalently, as is best illustrated in FIG. 3, each bottom 92 of the ram body 84 is broken by a groove 106 that extends across the bottom 92 and connects to the groove 94 off the packer element 96. A bottom seal 108 is mounted in the bottom groove 106 to provide a sliding seal with the surface of the guideway (not shown in the drawings) in which the ram 1 resides.

The top seal 104 and the bottom seal 108 thus cooperate with the packer element 96 to create a seal in the annulus between the drill pipe and the central vertical bore of the blowout preventer.

Figure 4:
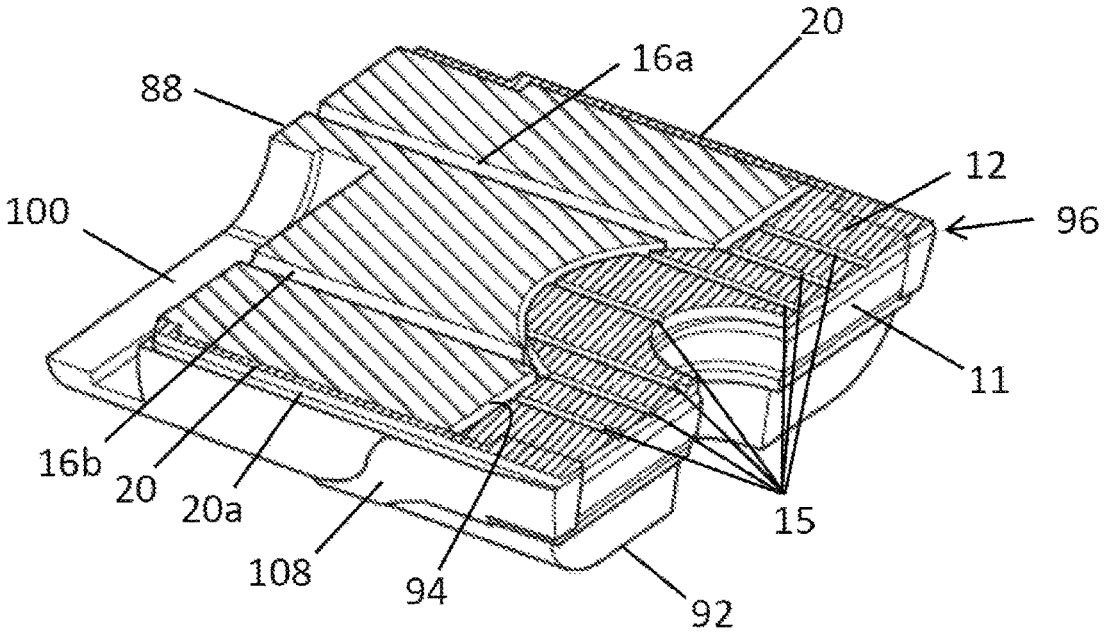
FIG. 4 shows a perspective illustration of a longitudinal horizontal cross-section through the ram illustrated in FIGS. 1 and 2.

Referring to FIGS. 1, 3 and 4, the packer element 96 comprises a first front seal 10 and a second front seal 11. The first front seal 10 cooperates with the top seal 104 and the second front seal 11 cooperates with the bottom seal 108. The first front seal 10 and the second front seal 11 are held in place and supported by a center packer support plate 12 located between the first front seal 10 and the second front seal 12. A top support plate 14 and a bottom support plate 13 (which are best visible in FIG. 3) may also be provided above the first front seal 10 and below the second front seal 11, the top support plate 14 and the bottom support plate 13 forming part of the packer element 96.

The packer element 96 is held in place by packer retainer pins 20 (see FIG. 4) which extend backwards along the sides of the ram body 84 and which are fixed to the ram body 84 towards its back end 88.

In use, two rams 1 are mounted in opposing guideways in a BOP. Actuators operate the rams to forward or retract them. In the forward position, the two rams will cooperate and seal around a drill pipe located in the BOP central vertical bore, as well as seal off the BOP central vertical bore, i.e., the volume below and above the rams. In this position, the two first front seals 10 of the two rams 1 cooperate and seal against each other, and together with the top seals 104, seal the central vertical bore for pressure from above. Similarly, the two second front seals 11 and the bottom seal 108 cooperate to seal for pressure from below the rams 1.

The center packer support plate 12 is provided with mid-plane packer pressure balance ports 15, with openings 15*a* for the ports provided at the front side of the center packer support plate 12. The mid-plane packer pressure balance ports 15 extend through the center packer support plate 12 and provide a fluid connection between the front and the back of the packer element 96, thus between the volume in front of the packer element 96 and the groove 94.

Body pressure balance ports 16*a* and 16*b* are provided through the ram body 84 which provide a fluid connection between the groove 94 and the back end 88 of the ram body 84.

The mid-plane packer pressure balance ports 15 and the body pressure balance ports 16*a* and 16*b* thereby provide a fluid connection between the volume in front of the ram 1 and that behind the ram 1, thus providing that there will be no significant pressure differential across the ram 1 when moving the ram in its guideway in a BOP.

The packer retainer pins 20 may be provided with retainer pins pressure balance ports 20*a*. The retainer pins pressure balance ports 20*a* may be provided as a groove or extrusion machined along the outer surface of the packer retainer pins 20, thus providing a pressure balance connection formed between the outer side of the packer retainer pins 20 and the guideway in which the ram 1 is mounted in the BOP. The retainer pins pressure balance ports 20*a* provide the same effect as above, i.e., of providing that the ram 1 can be moved in the guideway without problems.

Figure 5:
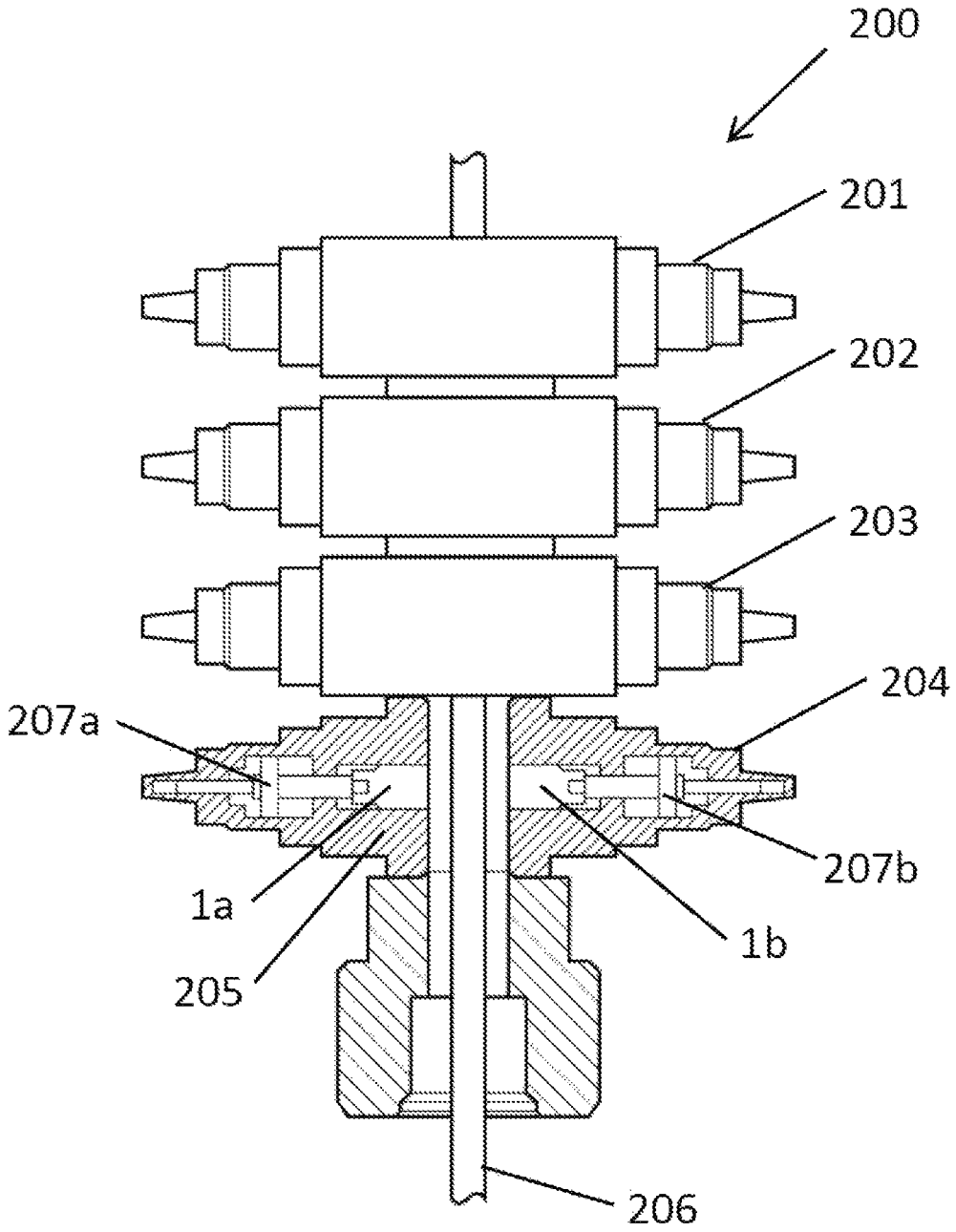
FIG. 5 shows a blowout preventer according to the second aspect of the present invention having two rams as illustrated in FIGS. 1-4.

FIG. 5 shows part of a blowout preventer (BOP) stack 200, comprising blowout preventers 201, 202, 203 and 204. The lowermost blowout preventer 204 has a first ram 1*a* and second ram *b* according to any one of the embodiments described above.

The blowout prevent may include a housing 205 having a main vertical passage for receiving a drill string 206, the first ram 1*a* and the second ram 1*b* being arranged in respective guideways in the housing 205 so that they are opposite to one another with the front of each ram facing into the main vertical passage. The first ram 1*a* and the second ram 1*b* are movable by actuators 207*a* and 207*b* between a closed position in which the first front seal 10 of the first ram 1*a* engages with the first front seal 10 of the second ram 1*b* and the second front seal 11 of the first ram 1*a* engages with the second front seal 11 of the second ram 1*b*, and an open position in which the front of the first ram 1*a* is spaced from the front of the second ram 1*b*.

Where the front of each of first ram 1*a* and second ram 1*b* is provided with a vertical semi-cylindrical groove 98 which extends from the top side to the bottom side of the ram, the rams can, for example, be arranged in the housing 205 so that when they are in the closed position, the vertical semi-cylindrical grooves 98 come together to form a cylindrical passage which extends generally parallel to a longitudinal axis of the main vertical passage in the housing 205. By virtue of this arrangement, the first ram 1*a* and the second ram 1*b* may seal around the drill string 206 extending through the lowermost blowout preventer 204 to close the main vertical passage of the housing 205 when a drill string 206 is present.

Where each of first ram 1*a* and second ram 1*b* includes a top seal 104 provided on the top 90 of the ram and a bottom seal 108 provided on the bottom 92 of the ram, the respective guideways may be provided with a corresponding seal surfaces which, when the rams are in the closed position, engage with the top seal 104 and bottom seal 108 to substantially prevent a leakage of fluid between the first ram 1*a* and the second ram 1*b* and the housing 205 from the main vertical passage of the housing 205 below the first ram 1*a* and the second ram 1*b* to the main vertical passage of the housing 205 above the first ram 1*a* and the second ram 1*b*, and vice versa.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the present invention in diverse forms thereof.

The present invention is not limited to the embodiments described herein; reference should be had to the appended claims.

What is claimed is:

1. A ram for a blowout preventer, the ram comprising:
a top side;
a bottom side;
a front;
a back;
a fluid communication channel arranged to extend through the ram from the front to the back;
a first front seal face arranged on the front of the ram above the fluid communication channel; and
a second front seal face arranged on the front of the ram below the fluid communication channel,
wherein,
the first front seal face is completely separate from the second front seal face.

2. The ram as recited in claim 1, further comprising:
a ram body comprising,
a front end,
a back end,
a front groove arranged to extend across the front end, and
a packer mounted in the front groove,
wherein,
the first seal face and second seal face are arranged on the packer mounted in the front groove.

3. The ram as recited in claim 2, wherein the fluid communication channel comprises,
a packer passage which is arranged to extend through the packer from a port located between the first seal face and the second seal face to the ram body, and
a ram body passage which is arranged to extend through the ram body from the front groove to the back end of the ram body.

4. The ram as recited in claim 3, wherein,
the packer comprises a plurality of ports arranged between the first seal face and the second seal face, and
the fluid communication channel further comprises a plurality of packer passages each of which is arranged to extend through the packer from one of the plurality of ports to the ram body.

5. The ram as recited in claim 4, wherein the fluid communication channel further comprises a plurality of ram body passages each of which is arranged to extend from the front groove to the back end of the ram body.

6. The ram as recited in claim 5, wherein a number of the plurality of packer passages is greater than a number of the plurality of ram body passages.

7. The ram as recited in claim 2, further comprising:
a packer retaining pin arranged to extend from the front to the back of the ram, the packer retaining pin being configured to engage with the packer and the ram body so as to retain the packer in the front groove.

8. The ram as recited in claim 7, wherein the fluid communication channel comprises a passage which is arranged to extend along the packer retaining pin from the front to the back of the ram.

9. The ram as recited in claim 2, further comprising:

a top seal face arranged on the top side of the ram; and a bottom seal face arranged on the bottom side of the ram.

10. The ram as recited in claim 9, wherein the top seal face and bottom seal face are arranged to cooperate with the packer so as to provide the top seal loop and the bottom seal loop.

11. The ram as recited in claim 10, wherein, the top seal face cooperates with the first front seal face to provide the top seal loop, and the bottom seal face cooperates with the second front seal face to provide the bottom seal loop.

12. The ram as recited in claim 1, wherein the front of the ram comprises a semi-cylindrical groove which is arranged to extend from the top side to the bottom side of the ram.

13. A blowout preventer (BOP) comprising a first ram as recited in claim 1 and a second ram as recited in claim 1.

14. The blowout preventer as recited in claim 13, further comprising:

a housing comprising a main passage, wherein, the first ram and the second ram are arranged in the housing so that the first ram and the second ram are opposite to one another with the respective front of each of the first ram and the second ram facing into the main passage, and the first ram and the second ram are arranged to be movable between a closed position in which the first front seal face of the first ram engages with the first front seal face of the second ram and the second front seal face of the first ram engages with the second front seal face of the second ram, and an open position in which the front of the first ram is spaced from the front of the second ram.

15. The blowout preventer as recited in claim 14, wherein, the respective front of each of the first ram and the second ram further comprises a semi-cylindrical groove which is arranged to extend from the top side to the bottom side, and the first ram and the second ram are arranged in the housing so that, when the first ram and the second ram are in the closed position, the semi-cylindrical grooves come together to form a cylindrical passage which extends generally parallel to a longitudinal axis of the main passage in the housing.

16. The blowout preventer as recited in claim 15, wherein each of the first ram and the second ram further comprises a top seal face arranged on the top side and a bottom seal face arranged on the bottom side, and the housing comprises corresponding seal surfaces which, when the first ram and the second ram are in the closed position, engage with the top seal face and bottom seal face so as to substantially prevent a leakage of a fluid between the first ram, the second ram and the housing from the main passage of the housing below the first ram and the second ram to the main passage of the housing above the first ram and the second ram, and from the main passage of the housing above the first ram and the second ram to the main passage of the housing below the first ram and the second ram.

17. A ram for a blowout preventer, the ram comprising:

a top side;

a bottom side;

a front;

a back;

a fluid communication channel arranged to extend through the ram from the front to the back;

a first front seal face arranged on the front of the ram above the fluid communication channel;

a second front seal face arranged on the front of the ram below the fluid communication channel; and a ram body comprising, a front end, a back end, a front groove arranged to extend across the front end, and a packer mounted in the front groove, the packer comprising a plurality of ports arranged between the first seal face and the second seal face, wherein, the first seal face and second seal face are arranged on the packer mounted in the front groove, and the fluid communication channel comprises, a packer passage which is arranged to extend through the packer from a port located between the first seal face and the second seal face to the ram body, a ram body passage which is arranged to extend through the ram body from the front groove to the back end of the ram body, and a plurality of packer passages each of which is arranged to extend through the packer from one of the plurality of ports to the ram body.

18. A ram for a blowout preventer, the ram comprising:

a top side;

a bottom side;

a front;

a back;

a fluid communication channel arranged to extend through the ram from the front to the back;

a first front seal face arranged on the front of the ram above the fluid communication channel;

a second front seal face arranged on the front of the ram below the fluid communication channel;

a ram body comprising, a front end, a back end, a front groove arranged to extend across the front end, and a packer mounted in the front groove; and a packer retaining pin arranged to extend from the front to the back of the ram, the packer retaining pin being configured to engage with the packer and the ram body so as to retain the packer in the front groove, wherein, the first seal face and second seal face are arranged on the packer mounted in the front groove.

19. The ram as recited in claim 18, wherein the fluid communication channel comprises a passage which is arranged to extend along the packer retaining pin from the front to the back of the ram.

* * * * *